United States Patent [19]

O'Neal

[11] Patent Number: 4,744,497

[45] Date of Patent: May 17, 1988

[54] SECURITY WALLET

[76] Inventor: William T. O'Neal, 10449 Yorkford Dr., Dallas, Tex. 75238

[21] Appl. No.: 940,053

[22] Filed: Dec. 10, 1986

[51] Int. Cl.[4] ..... A45C 1/06; A45C 11/32

[52] U.S. Cl. ..... 224/202; 224/229; 150/134; 150/145; 150/147; 150/149

[58] Field of Search ..... 224/253, 202, 257, 258, 224/218, 219, 229; 150/131, 132, 134, 143, 144, 146, 147, 149; 206/37, 321, 38; 40/10 R; 70/456 R, 457, 458

[56] References Cited

U.S. PATENT DOCUMENTS

| | | | |
|---|---|---|---|
| 522,747 | 7/1894 | Waldenberger | 150/131 |
| 1,305,569 | 6/1919 | Smith | 150/132 |
| 1,939,761 | 12/1933 | Buxton | 150/132 |
| 2,619,144 | 11/1952 | Niswander | 150/146 |
| 2,627,886 | 2/1953 | Barnes | 150/143 X |
| 2,629,251 | 2/1953 | Schwalberg | 70/457 |
| 2,737,991 | 3/1956 | Bass | 150/132 |
| 2,746,504 | 5/1956 | Powell | 150/132 X |
| 2,825,378 | 3/1958 | Vaca | 150/143 |
| 4,037,716 | 7/1977 | Marks | 206/38 |
| 4,306,433 | 12/1981 | Kelly | 70/456 R |
| 4,332,338 | 6/1982 | Christiansen | 224/222 |
| 4,358,944 | 11/1982 | Stoffel | 70/457 |
| 4,367,830 | 1/1983 | Jacquith et al. | 224/258 |
| 4,570,688 | 2/1986 | Williams | 150/134 |

FOREIGN PATENT DOCUMENTS

| | | | |
|---|---|---|---|
| 24392 | 4/1919 | Denmark | 150/134 |
| 2230310 | 12/1974 | France | 150/132 |

*Primary Examiner*—Henry J. Recla
*Assistant Examiner*—Ernest G. Cusick
*Attorney, Agent, or Firm*—Henderson & Sturm

[57] ABSTRACT

A security wallet including body portions formed by the folding and stitching of a linear strip of flexible material. The wallet, when formed, has an indentification card compartment with a slot opening, a currency compartment with a selectively closable flap, and an open key compartment. A pair of integral loops are formed near the opening of the key compartment and a neck lanyard is attached to one loop while a key chain is attached to the other loop.

10 Claims, 2 Drawing Sheets

SECURITY WALLET

TECHNICAL FIELD

This invention relates to wallets, and more particularly to wallets to organize and carry a few essential items.

BACKGROUND ART

A variety of wallets are known, yet each has its disadvantages by lacking utility, versatility and appeal. No known wallet is designed to carry only the essential things a person needs while engaging in sports or other activities where the carrying of non-essential items is impractical and inconvenient.

Those concerned with these and other problems recognize the need for an improved security wallet.

DISCLOSURE OF THE INVENTION

The present invention provides a security wallet including body portions formed by the folding and stitching of a linear strip of flexible material. The wallet, when formed, has an identification card compartment with a slot opening, a currency compartment with a selectively closable flap, and an open key compartment. A pair of integral loops are formed near the opening of the key compartment and a neck lanyard is attached to one loop while a key chain is attached to the other loop.

The identification card compartment is designed to display personal identification, medical information or warnings. The currency compartment is able to accommodate one to three credit cards, one to three pieces of folded currency and emergency telephone change. The key compartment is designed to hold two or three keys and the neck lanyard.

The wallet can be worn on the adjustable lanyard around the neck. The wallet is designed to carry only the essential items a person needs with them while jogging, swimming or engaging in any other sport or activity where they want to leave non-essential items behind. The wallet may be formed of various flexible materials that are washable, durable and comfortable to wear. When using the wallet, valuable items need not be left in lockers, in automobiles, or on the beach.

The security wallet is an alternative to the conventional wallet, when carrying a conventional wallet is not practical or desirable. The primary purpose of the security wallet is to conveniently carry essential items while engaging in activities where security of the items, and/or freedom of hands is desirable. The wallet is useful for travelers seeking security from pick-pockets, and for latch-key children for keeping lunch money, door keys and identification in a safe convenient place inside a shirt or blouse. Further, the wallet can be used by senior citizens using canes or walkers who cannot or do not want to carry a purse.

Also, senior citizens would benefit from the ease of use and the fact that it would be difficult to lose or misplace. Medical information as well as identification would be immediately available in case of accident.

An object of the present invention is the provision of an improved security wallet.

Another object is to provide a security wallet that is convenient to use.

A further object of the invention is the provision of a security wallet that is suitable for use while engaging in diverse activities.

Still another object is to provide a security wallet that is easy and inexpensive to manufacture.

A still further object of the present invention is the provision of a security wallet that is suitable for carrying essential items.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
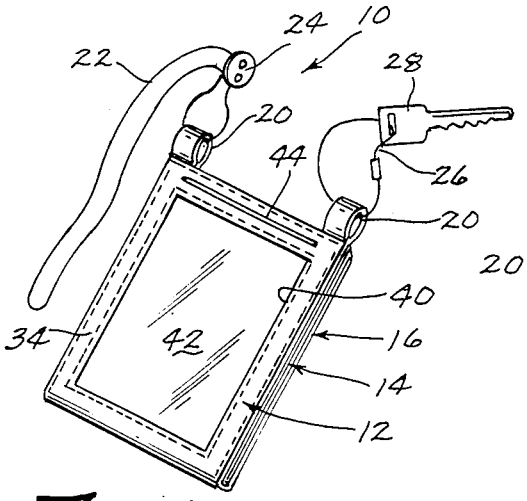
FIG. 1 is a perspective view of the security wallet of the present invention where the wallet includes an attached adjustable neck lanyard and an attached key chain.
Figure 2:
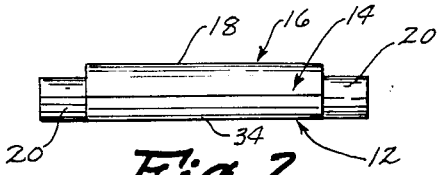
FIG. 2 is a top plan view of the wallet.
Figure 3:
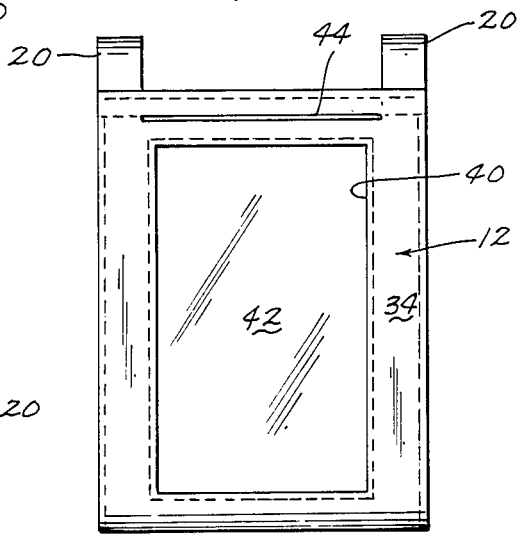
FIG. 3 is a side elevational view showing the identification card compartment.
Figure 4:
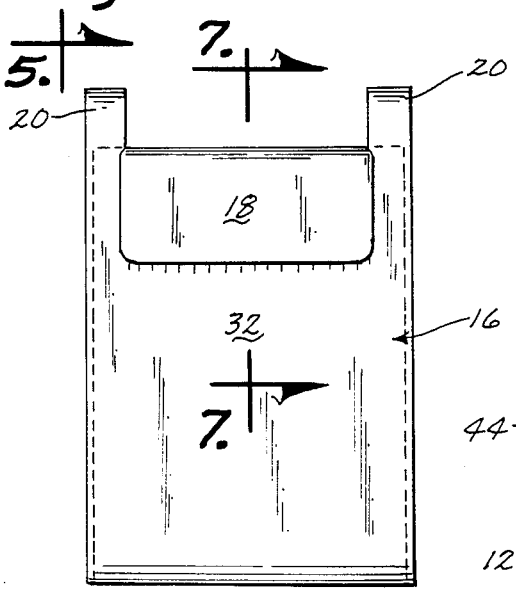
FIG. 4 is a side elevational view of the side having the currency compartment.
Figure 5:
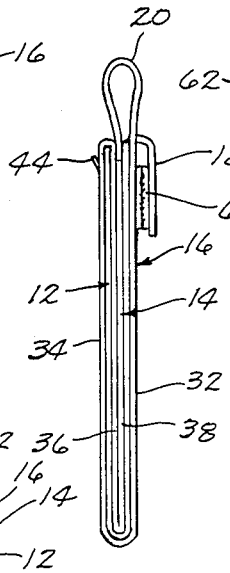
FIG. 5 is a side elevational view taken along line 5—5 of FIG. 4.
Figure 6:
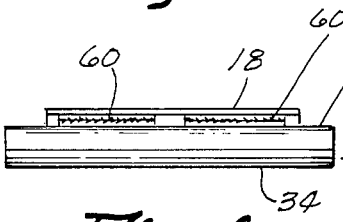
FIG. 6 is a bottom plan view of the wallet.

Referring now to the drawings, wherein like reference numerals designate identical or corresponding parts throughout the several views, FIG. 1 shows the security wallet of the present invention generally designated by the reference numeral (10). As seen by reference to FIGS. 1–7, the wallet (10) includes an identification card compartment (12), a centrally located open top key compartment (14), a currency compartment (16) having a selectively closable flap (18), and a pair of loops (20). A neck lanyard (22) having an adjustment button (24) is attached to one of the loops (20), and a key chain (26), with attached keys (28), is secured to the other loop (20).

As best shown in FIGS. 8–11, the wallet (10) includes a body portion formed of a continuous linear strip (30) of flexible material such as leather-grained vinyl. The strip (30) is divided into four rectangular panels (32, 34, 36 and 38) all having equal dimensions. The strip (30) also includes a pair of outwardly extending spaced tabs (20') extending from the end of panel (32), and an outwardly extending flap (18') extending from the end of panel (38). As most clearly shown in FIGS. 8 and 9, the tabs (20') are spaced apart a distance equal to the width of flap (18'), whereby waste of the flexible material is minimized. Panel (34) includes a centrally located window opening (40) that is covered by an attached sheet of transparent material (42), and a slot opening (44) is formed in panel (34).

Figure 9:
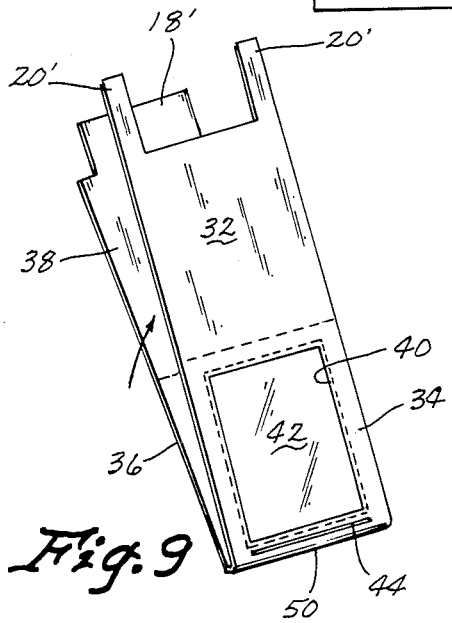
FIG. 9 is a perspective view illustrating the strip being first folded along its centerline.
Figure 10:
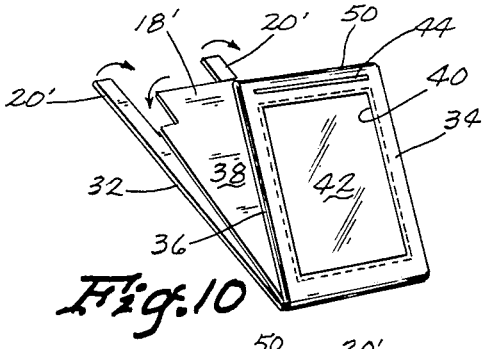
FIG. 10 is a perspective view illustrating the strip being further folded to form the body portion of the wallet.
Figure 11:
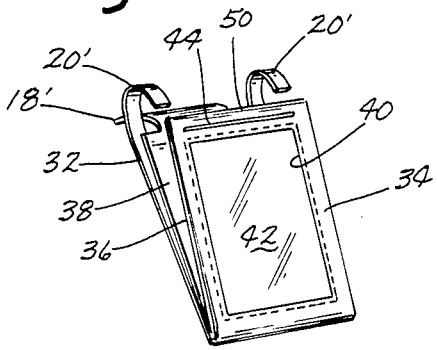
FIG. 11 is a perspective view illustrating the folding of the tabs to form the pair of loops, and the folding of the flap for the currency compartment, just prior to stitching of the panels to form the three compartments.

FIG. 9 illustrates the strip (30) folded first along its centerline (50). FIG. 10 illustrates the strip (30) folded again such that the ends of panels (32 and 38) are in registry with the centerline (50), wherein panels (32 and 34) form the exterior of the body portion and panels (36 and 38) form the interior of the body portion. FIG. 11 illustrates the strip (30) where the tabs (20') are positioned between panels (36 and 38) just prior to stitching. When secured by stitching, the tabs (20') form loops (20) as most clearly shown by FIG. 7. The stitching interconnects the three sides of each panel (32, 34, 36 and 38) to form the three compartments (12, 14 and 16).

Figure 7:
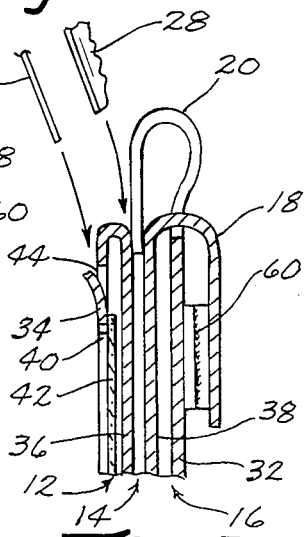
FIG. 7 is an enlarged sectional view taken along line 7—7 of FIG. 4, illustrating the insertion of a card into the identification card compartment and the inspection of a key into the centrally located key compartment.
Figure 8:
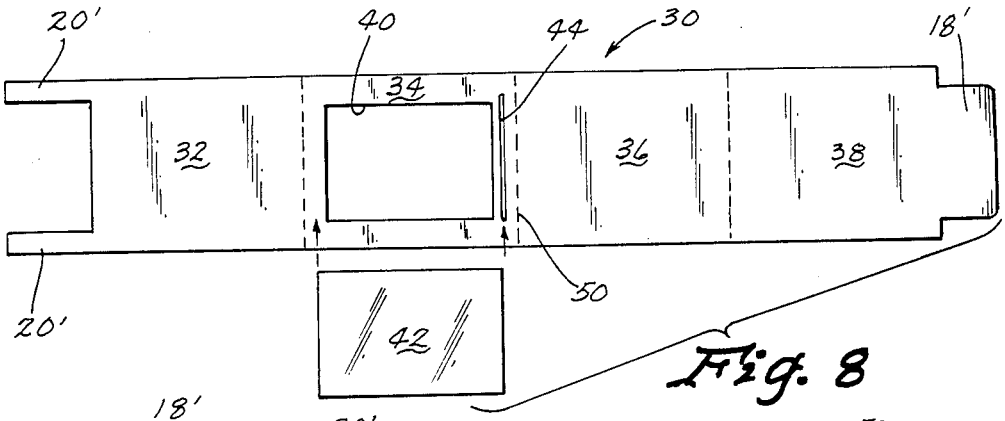
FIG. 8 is a plan view of the continuous linear strip of flexible material from which the body section, loops and flap are formed; and illustrating the position of the transparent plastic material positioned over the window opening in one of the four rectangular panels.
Figure 12:
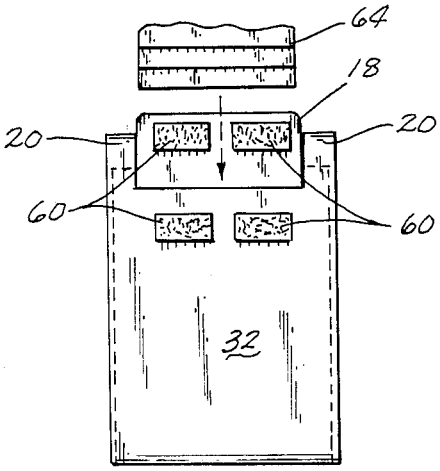
FIG. 12 is a side elevational view illustrating a credit card being inserted into the currency compartment.

As best shown in FIG. 12, VELCRO segments (60) are attached to the flap (18) and the panel (32) to selectively secure the flap (18) to close the currency compartment (16). FIGS. 7 and 12, illustrate the insertion of a card (62) through the slot opening (44) to place the card (62) in the identification card compartment (12), the insertion of keys (28) into the key compartment (14), and the insertion of a credit card (64) into the open currency compartment (16).

A wallet (10) is provided that accommodates essential items and allows the user maximum physical flexibility.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A security wallet, comprising:

a body portion formed of a continuous linear strip of flexible material, said strip having a centerline, one end, and another end, said strip being divided into four rectangular panels of equal length, said strip being folded first along said centerline such that said one end is in registry with said another end, and being folded again such that both ends are in registry with the centerline, said body portion having an exterior and an interior, wherein two of said panels on one side of the centerline form exterior panels of said body portion and two of said panels on the other side of the centerline form interior panels of said body portion;

one of said panels on the exterior of said body portion adjacent the centerline having a window opening formed centrally therein and a slot opening formed adjacent the window opening, said slot being adapted to receive an identification card;

means for interconnecting the three sides of each panel remote from the centerline such that the exterior panel having the window opening and its adjacent interior panel forms an identification card compartment having said slot opening, the other exterior panel and its adjacent interior panel forms an open currency compartment, and the two interior panels form an open key compartment.

2. The security wallet of claim 1 wherein said slot opening is formed intermediate the window opening and the centerline.

3. The security wallet of claim 1 wherein said window opening is covered with a sheet of transparent material.

4. The security wallet of claim 1 wherein said means for interconnecting the three sides of each panel is stitching.

5. The security wallet of claim 1 wherein said one end of said linear strip includes a pair of outwardly extending spaced tabs having free ends, and wherein the free ends of each tab is stitched to said body portion adjacent said centerline to form a pair of loops.

6. The security wallet of claim 5 wherein said another end of said linear strip includes an outwardly extending flap, and wherein said flap is disposed over said open currency compartment when said body portion is formed.

7. The security wallet of claim 6 wherein said pair of outwardly extending tabs are spaced apart a distance equal to the width of said flap, whereby waste of the flexible material is minimized.

8. The security wallet of claim 5, wherein a neck lanyard is attached to one of the pair of loops, and a key chain with attached keys is attached to the other of the pair of loops.

9. The security wallet of claim 8 wherein an adjusting button is attached to said neck lanyard.

10. The security wallet of claim 1 further including a selectively closable flap attached adjacent said centerline and disposed over said open currency compartment.

* * * * *